US007238041B2

(12) United States Patent
Katsuma

(10) Patent No.: US 7,238,041 B2
(45) Date of Patent: Jul. 3, 2007

(54) CONNECTOR

(75) Inventor: Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/116,037

(22) Filed: Apr. 27, 2005

(65) Prior Publication Data

US 2005/0245124 A1 Nov. 3, 2005

(30) Foreign Application Priority Data

Apr. 28, 2004 (JP) ..... 2004-133800

(51) Int. Cl.
*H01R 13/627* (2006.01)

(52) U.S. Cl. ..... 439/354

(58) Field of Classification Search ..... 439/250–358, 439/489

See application file for complete search history.

(56) References Cited

U.S. PATENT DOCUMENTS 5,628,649 A * 5/1997 Yagi et al. ..... 439/354
5,743,760 A 4/1998 Inaba et al.
6,325,656 B1 * 12/2001 Fukuda et al. ..... 439/358
7,140,908 B2 * 11/2006 Katsuma ..... 439/489
2002/0037661 A1 * 3/2002 Endo ..... 439/352
2003/0040210 A1 * 2/2003 Herlinger et al. ..... 439/352

* cited by examiner

*Primary Examiner*—Felix O. Figueroa
(74) *Attorney, Agent, or Firm*—Gerald E. Hespos; Anthony J. Casella

(57) ABSTRACT

A hood (14) is provided in a male housing (11). The hood (14) has an inwardly projected locking claw (16) for keeping the female housing (21) fit in the male housing (11) when a to-be-locked portion (47) of a female housing (21) is locked to the locking claw (16). A locking means penetration space (17) is provided rearward from the locking claw (16) for receiving the to-be-locked portion (47) of the female housing (21). The locking means penetration space (17) opens to the outside along a direction intersecting a fit-in/separation direction of the female housing (21). A rear of the locking means penetration space (17) inside the hood (14) has an inwardly projecting reinforcing rib (18) opposite the locking claw (16) and extended in the fit-in/separation direction of the female housing (21).

11 Claims, 20 Drawing Sheets

CONNECTOR

BACKGROUND OF THE INVENTION

1. Field of the Invention

The present invention relates to a connector.

2. Description of the Related Art

U.S. Pat. No. 5,743,760 and FIG. 21 herein relate to a locking construction for keeping a connector and a mating connector in a connected condition. With reference to FIG. 21, the connector has a housing 1 and the mating connector 2 can be fit into a hood 3 of the housing 1. The mating connector 2 has a to-be-locked part 4 that engages a lock 5 that projects in at the front end of an upper portion of the hood 3 for keeping the mating connector 2 fit in the housing 1. The housing 1 has a locking means penetration space 6 at the rear of the lock 5 for permitting the entry of the to-be-locked portion 4 therein.

The vertical dimension of the connector often is limited and can be achieved by making the hood 3 thinner. However, a thin hood 3 can be weak and deformable. Thus the lock 5 and the to-be-locked portion 4 can unlocked from each other even though both connectors are in a fit-in state.

The locking means penetration space 6 is rearward from the lock 5 and is open rearward because a core of a molding die for shaping the rear surface of the lock 5 is drawn rearward when a resin is molded into the housing 1. Therefore, the locking construction of a reinforcing construction cannot be formed where the locking means penetration space 6 is formed.

The invention has been completed in view of the above-described situation. Therefore it is an object of the present invention to improve the strength of a hood part.

SUMMARY OF THE INVENTION

The invention relates to a connector with a housing that has a hood in which a mating connector can be fit. A lock projects inwardly in the hood and can engage a to-be-locked portion of the mating connector to keep the mating connector fit in the hood. A locking means penetration space is formed rearward from the lock for receiving the to-be-locked portion of the mating connector. The locking means penetration space is open to the outside along a direction intersecting a fit-in/separation direction of the mating connector. A reinforcement projects inside the hood rearward of the locking means penetration space and opposed to the lock. The reinforcement extends in the fit-in/separation direction of the mating connector and strengthens the hood.

Guide surfaces preferably are formed at widthwise ends of a surface of the reinforcement opposed to the lock for guiding the mating connector into the connector. Thus, the reinforcing rib will not catch the mating connector.

The guide surfaces narrow the gap between the guide surfaces and the side surfaces of the locking means penetration space. Thus, the portion of the molding die for shaping the locking means penetration space and the portion for shaping the guide surfaces are narrow. Hence there is a fear that the portions of the molding die will be weak. However, the locking means penetration space preferably becomes gradually wider towards the guide surfaces. Therefore, larger gaps are provided between the guide surfaces and the side surfaces of the locking means penetration space. Accordingly, the portion of the molding die for shaping the locking means penetration space and the portion for shaping the guide surfaces can be sufficiently strong.

The hood could be too long for the mating connector, and the mating connector could advance forward beyond the predetermined normal position. Accordingly, the mating connector preferably has a stop that strikes the hood when the to-be-locked portion is pressed into the hood to a predetermined normal depth at which the to-be-locked portion is locked to the lock. Consequently, the mating connector cannot advance excessively into the hood.

DETAILED DESCRIPTION OF THE PREFERRED EMBODIMENTS

Figure 9:
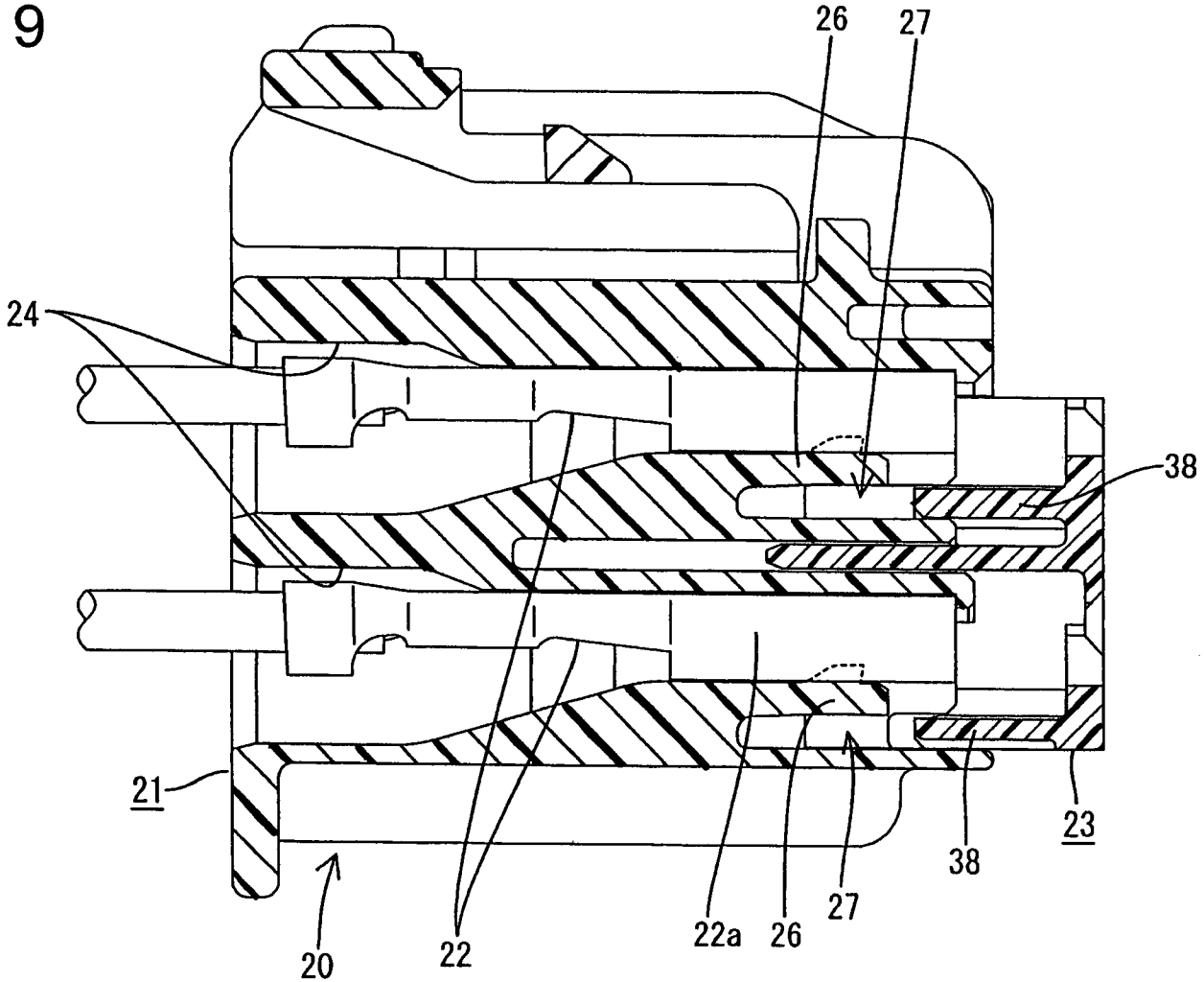
FIG. 9 is a sectional side elevation of a state after the female terminal fittings are inserted into the female housing in which the front retainer is mounted on the temporary locking position.
Figure 10:
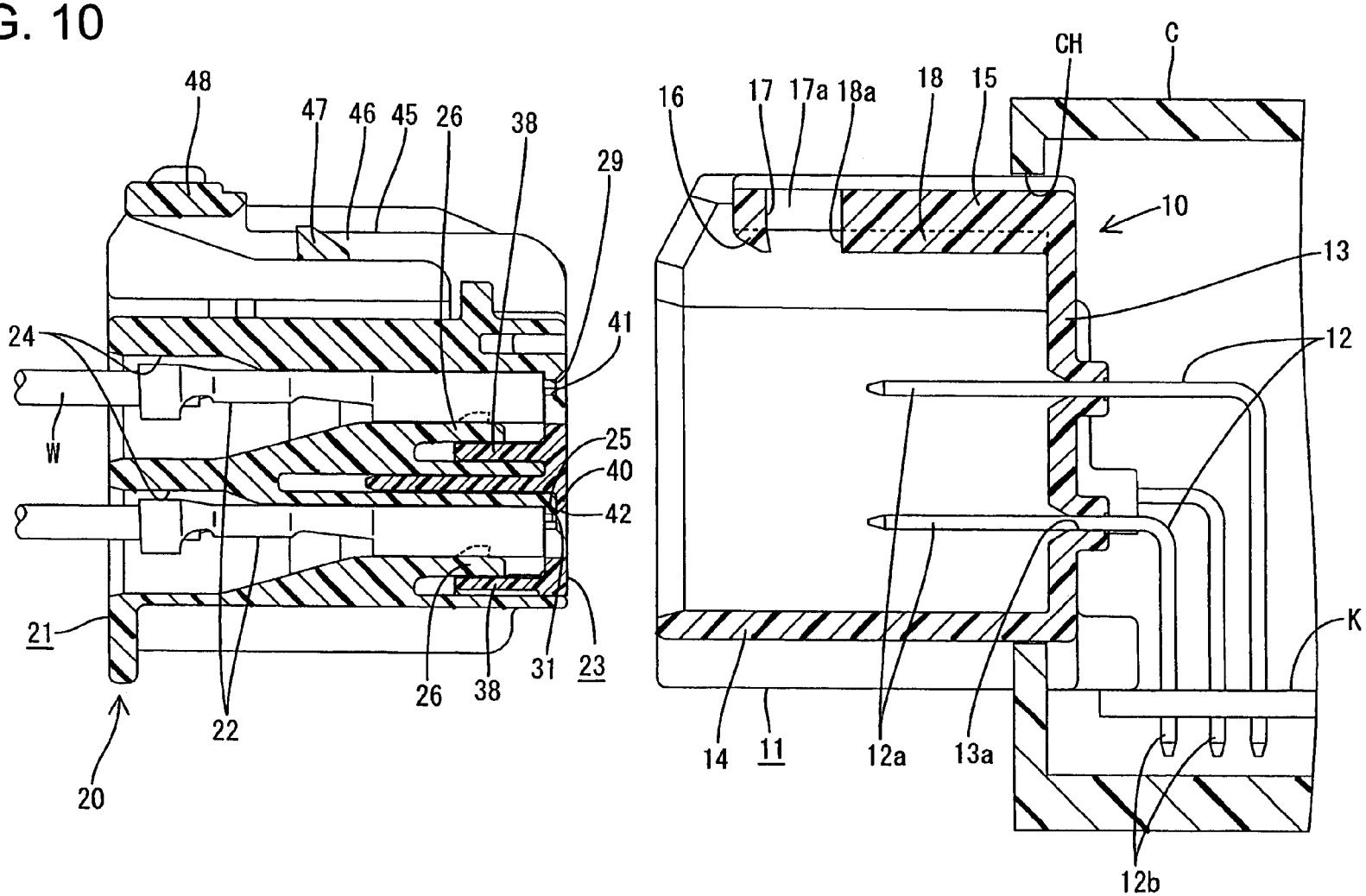
FIG. 10 is a sectional side elevation of a state before the female housing in which the front retainer is mounted on a main locking position is fitted in the male housing.

A connector assembly according to first embodiment of the invention is illustrated in FIGS. 1 through 17, and includes a male connector 10 and a female connector 20, as shown most clearly in FIG. 10. The male connector 10 is mounted on a substrate K accommodated in a casing C so that part of the male connector 10 penetrates through an opening CH in a wall of the casing C. The female connector 20 is fit in the male connector 10 from the outside of the casing C. The fit-in end of each connector 10, 20 is referred to herein as the front. The terms upper and lower are used herein as a convenient frame of reference, and refer to the orientation shown in FIGS. 1 and 10. However, the terms upper and lower do not imply a required gravitational orientation.

Figure 1:
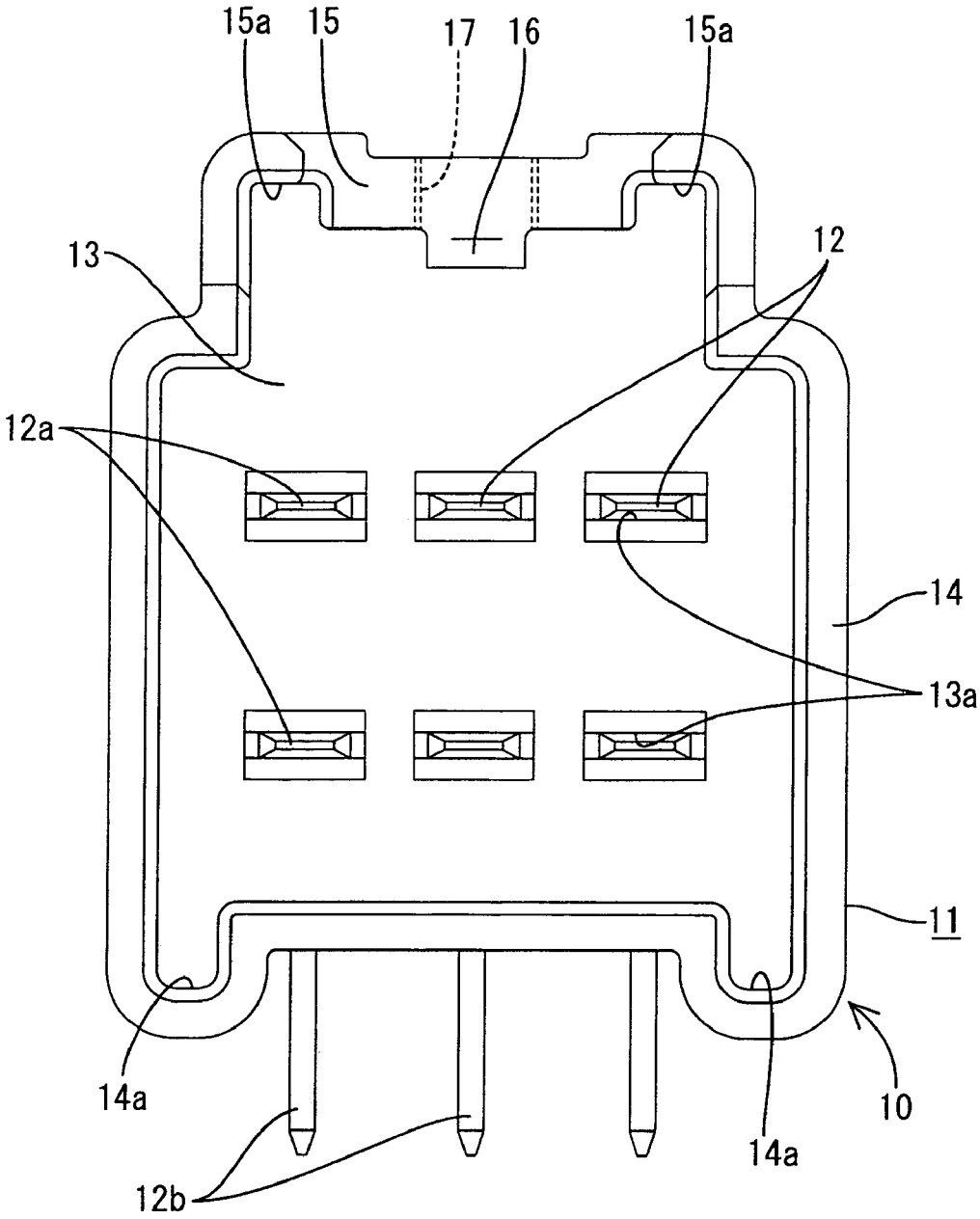
FIG. 1 is a front view of a male housing according to a first embodiment of the present invention.

As shown in FIGS. 1 and 10, the male connector 10 has a male housing 11 made of synthetic resin and male terminal fittings 12 are mounted in the male housing 11. The male housing 11 has a terminal fitting-holding part 13 for holding the male terminal fittings 12, and a hood 14 that projects forward from the terminal fitting-holding part 13. Six terminal insertion holes 13*a* are formed through the terminal fitting-holding part 13. More particularly, three of the terminal insertion holes 13*a* are in an upper row and three are in a lower row, as shown most clearly in FIG. 1. The male terminal fittings 12 can be inserted into the terminal insertion holes 13*a* from the rear of the male housing 11. The male terminal fittings 12 are approximately L-shaped in a side view. Each male terminal fitting 12 has a connector connection end 12*a* that extends horizontally into the hood 14 for electrical connection with the female connector 20. Each male terminal fitting 12 also has a substrate connection portion 12*b* that extends vertically through a hole of the substrate K for soldered electrical connection to an unshown electrical path on the substrate K. The hood 14 is an approximately square tube with an open front and the female connector 20 can be fit into the hood 23 from the front. The upper part of the hood 14 is narrower than lower parts thereof. The hood 14 has an upper wall 15 and receiving grooves 15*a* are formed at both widthwise ends of an inner surface of the upper wall 15. Thus, a portion of the upper wall 15 between the receiving grooves 15*a* is lower than both widthwise ends. A front end of the upper wall 15 of the hood 14 is disposed rearward from the front ends of other peripheral walls of the hood 14. Guide grooves 14*a* are formed at both widthwise ends of a lower wall of the hood 14.

Figure 3:
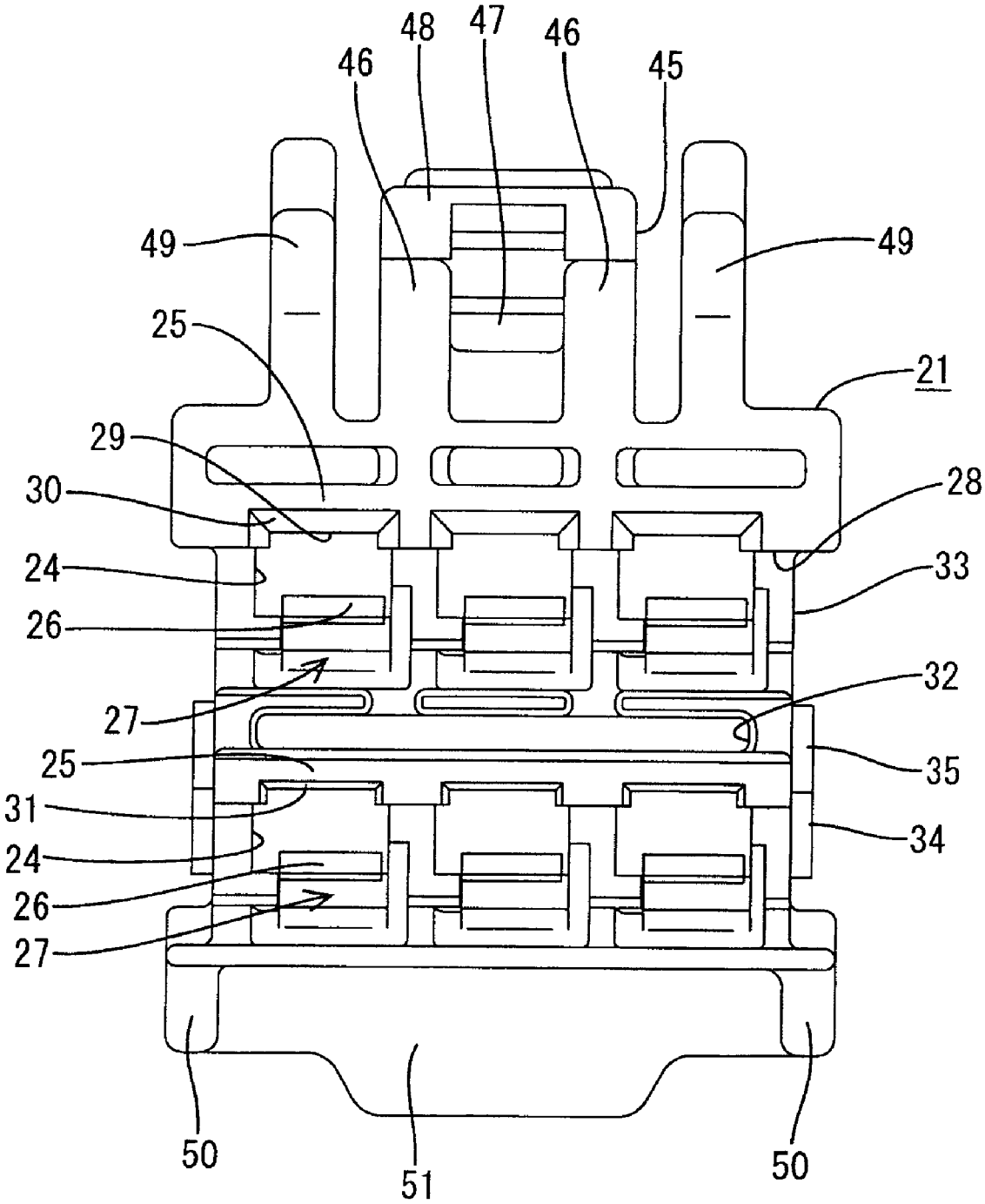
FIG. 3 is a front view of a female housing.
Figure 7:
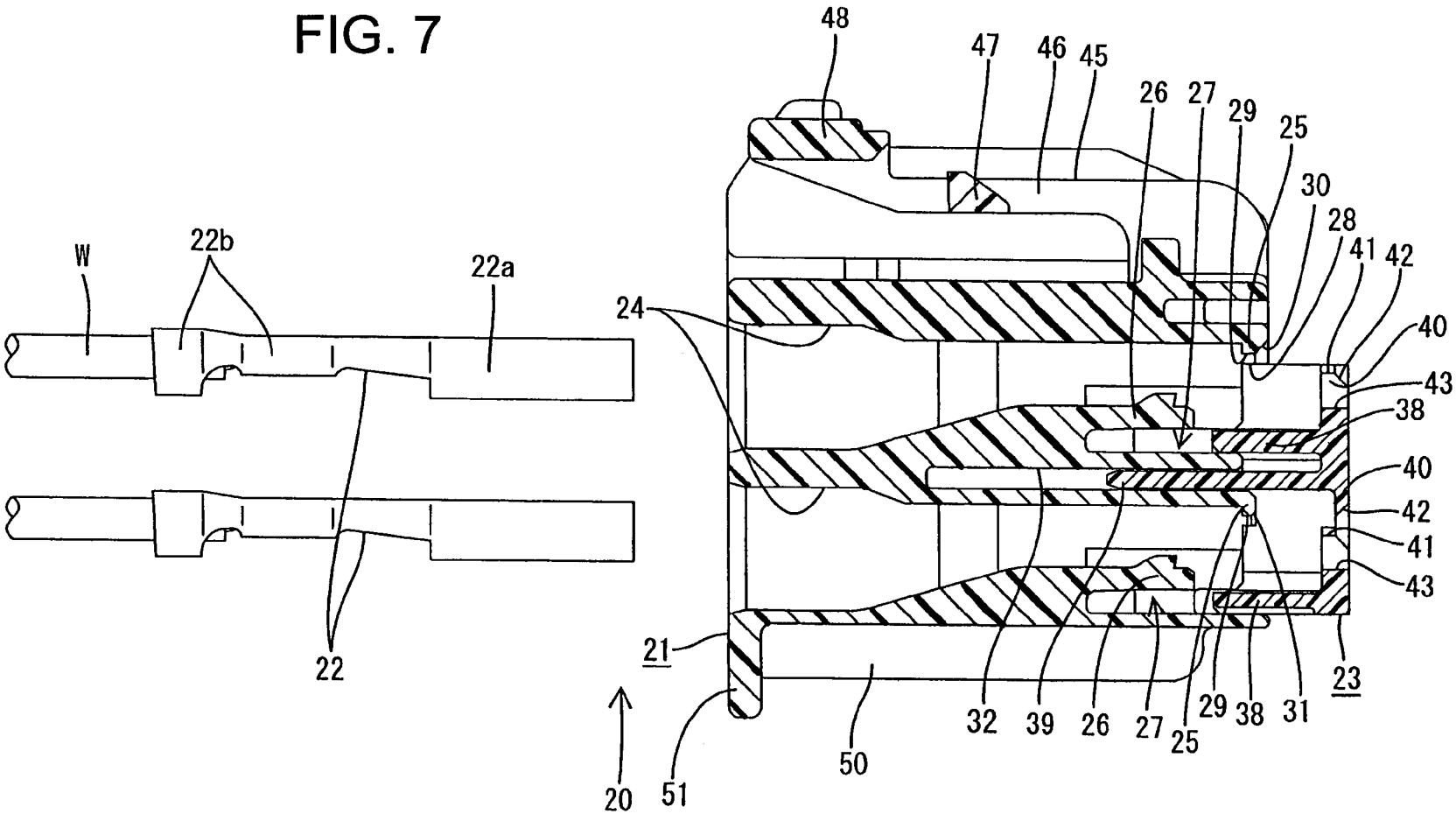
FIG. 7 is a sectional side elevation of a state before female terminal fittings are inserted into a female housing in which a front retainer is mounted on a temporary locking position.

As shown in FIGS. 3 and 7, the female connector 20 has a block-shaped female housing 21 made of synthetic resin and female terminal fittings 22 are accommodated in the female housing 21. A front retainer 23 is mounted on the front of the female housing 21. Six cavities 24 are formed through the female housing 21. Three of the cavities 24 are disposed side-by-side in an upper row and three are disposed in a lower row. The female terminal fittings 22 can be inserted into the cavities 24 from the rear. A front wall 25 is formed at a front end of each cavity 24 for stopping the inserted female terminal fittings 22 at front positions. A lance 26 is provided on a lower surface of each cavity 24 for locking the female terminal fitting 22. Each lance 26 is cantilevered and is elastically deformable vertically in directions intersecting the fit-in/separation direction of the female terminal fitting 22. The deformed lance 26 withdraws into a flexible space 27 below the lance 26. The female terminal fitting 22 has a box-shaped body 22*a* and a barrel 22*b* to be connected to the end of an electric wire W. A locking hole (not shown) is formed on a lower surface of the body 22*a* for receiving the lance 26. Thus, the lance 26 can be locked to a peripheral edge of the locking hole. The body 22*a* has an elastic contact piece (not shown) for elastically contacting the male terminal fitting 12.

Figure 5:
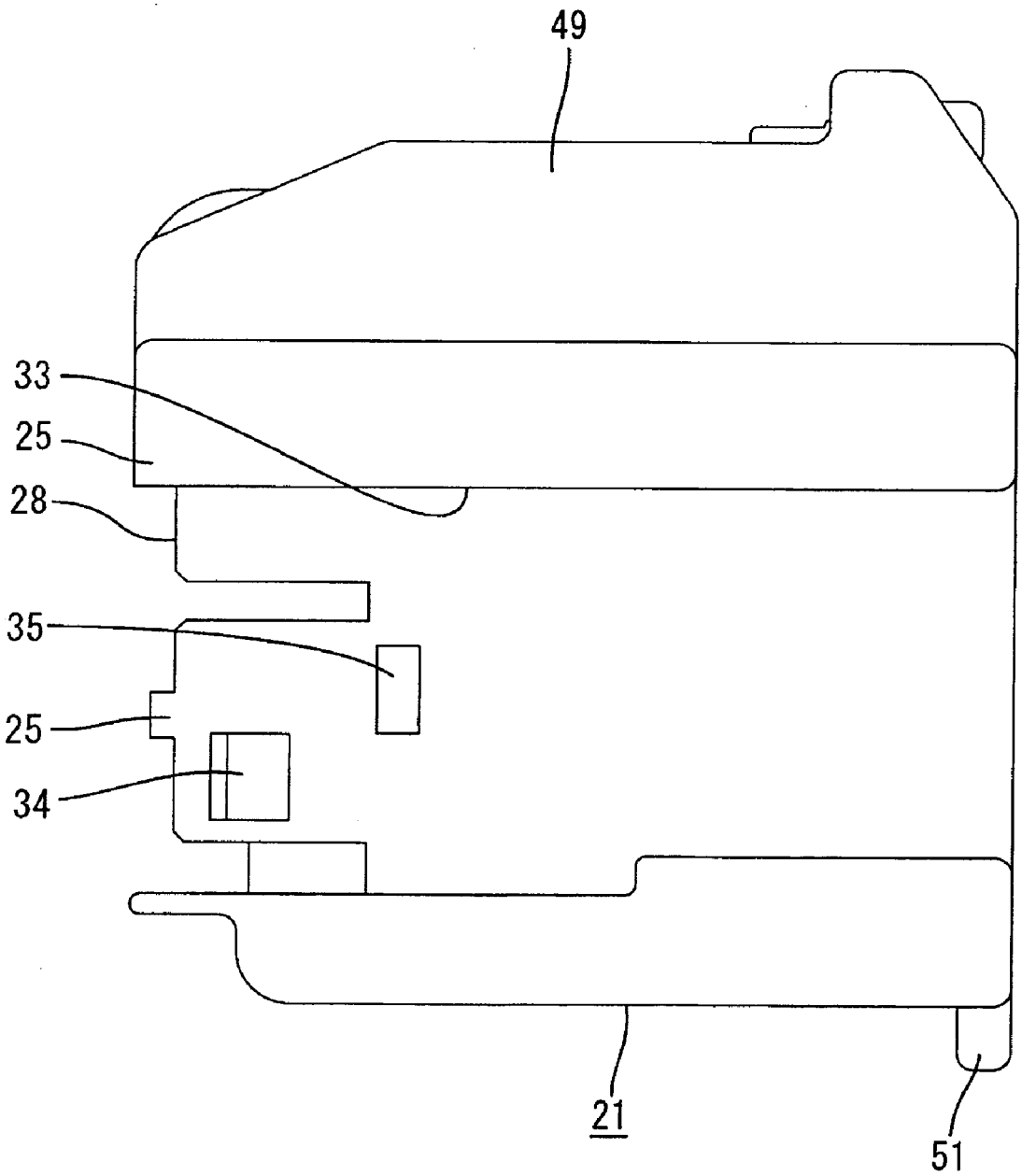
FIG. 5 is a side view of the female housing.

A front surface of the female housing 21 and both side surfaces thereof are cut out to accommodate the front retainer 23. More specifically, a cut-out 28 is formed on the front surface of the female housing 21 except a part of the front wall 25 of each cavity 24. The cut-out communicates with each cavity 24 and each flexible space 27. The cut-out 28 removes the lower half of the front wall 25 of each upper-row cavity 24 without removing the upper half of the front wall 25 thereof. Further, the lower half of the front wall 25 of each lower-row cavity 24 and the front of the upper half of the front wall 25 thereof are removed without removing the rear of the upper half of the front wall 25 thereof. The removed portions face the front retainer 23. A tab insertion opening 29 is formed longitudinally through the remaining portion of each of the upper and lower front walls 25 for receiving the male terminal fitting 12. A sloped tab guide surface 30 is formed at the front periphery of the upper tab insertion opening 29 for guiding the insertion of the male terminal fitting 12. An auxiliary guide surface 31 is formed on the periphery of the front end of the lower tab insertion opening 29 for guiding the insertion of the male terminal fitting 12. The cut-out 28 includes a concave guide 32 between the upper and lower cavities 24 for receiving a guide plate of the retainer 23. As shown in FIGS. 3 and 5, concavities 33 are formed on both side surfaces of the female housing 21. Each concavity 33 includes a projection 34 for holding the front retainer 23 at a temporary locking position, and a projection 35 for holding the front retainer 23 at a main locking position. The projections 34 and 35 are shifted from each other longitudinally and vertically.

Figure 6:
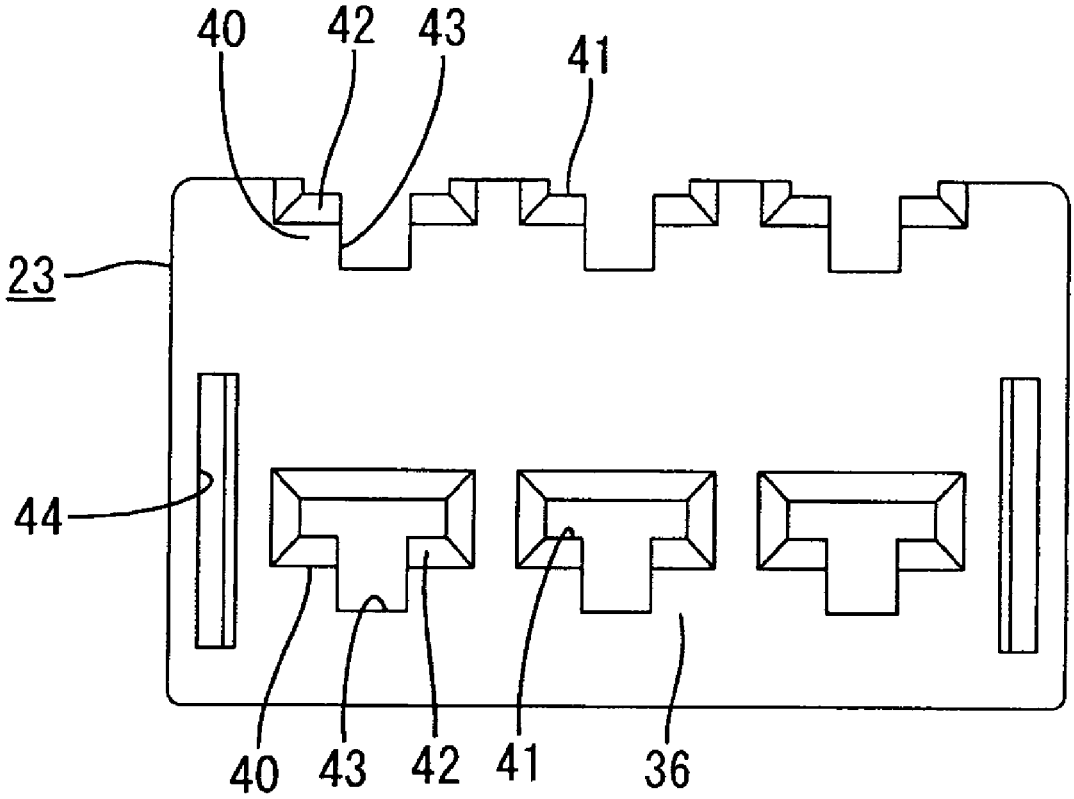
FIG. 6 is a front view of a front retainer.

The front retainer 23 is made of synthetic resin. As shown in FIGS. 6 and 7, the retainer 23 has a front plate 36 and two vertically long side plates 37 extend rearward from the sides of the front plate 36. Two elastic deformation prevention portions 38 extend rearward from a rear surface of the front plate 36, and a guide plate 39 extends rearward from a position on the rear surface of the front plate 36 between the elastic deformation prevention portions 38. The front plate 36 fits in the cut-out 28 of the female housing 21 and has a front wall 40 for each cavity 24 that cooperates with the front wall 25 of the female housing 21. More particularly, the front wall 40 includes the lower half of the front wall 25 of each upper-row cavity 24 of the female housing 21, the lower half of the front wall 25 of each lower-row cavity 24, and the front part of the upper half of the front wall 25. Tab insertion openings 41 extend through the front wall 40 and align with the tab insertion openings 29 of the female housing 21. Sloped tab guide surfaces 42 are formed on the periphery of the front end of the tab insertion opening 41 for guiding the male terminal fitting 12. A jig insertion opening 43 is formed in a lower edge of each tab insertion opening 41. Each jig insertion opening 41 can receive a jig (not shown) from the front of the female housing 21 for unlocking the lance 26.

Figure 11:
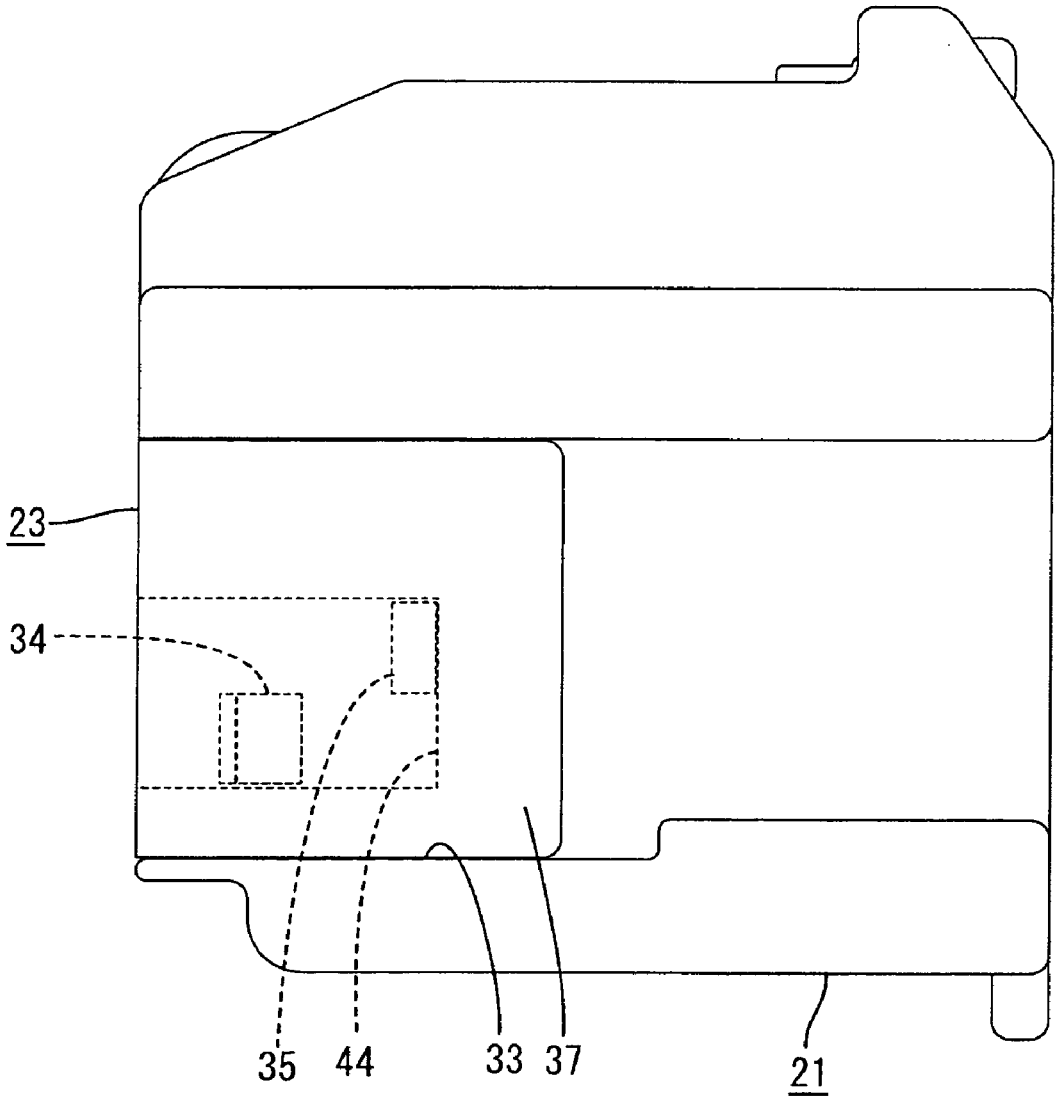
FIG. 11 is a side view of the female housing in which the front retainer is mounted on the main locking position.

The side plates 37 are inserted into the concavities 33 on the sides of the female housing 21. A locking groove 44 is formed on the surface of each side plate opposed to the female housing 21 and receives the projection 34 for holding the front retainer 23 at the temporary locking position or the projection 35 for holding the front retainer 23 at the main locking position. Thus, the front retainer 23 can be held selectively at the temporary locking position (FIG. 8) or the main locking position (FIG. 11). The outer surface of the side plate 37 is substantially flush with an outer side surface of the female housing 21 when the side plate 37 is in the concavity 33.

The elastic deformation prevention portions 38 are disposed respectively at positions corresponding to the upper and lower flexible spaces 27 of the female housing 21. The widthwise ends of the elastic deformation prevention portions 38 are connected to the inner surfaces of the respective side plates 37 to reinforce the elastic deformation prevention portion 38. As shown in FIGS. 7 and 9, the elastic deformation prevention portion 38 is forward from the flexible space 27 when the retainer 23 is at the temporary locking position in the female housing 21. Thus, the lances 26 can deform elastically so that the female terminal fittings 22 can be inserted into or removed from the cavities 24. On the other hand, the elastic deformation prevention portion 38 advances into the flexible spaces 27 and prevents deformation of the lances 26 when the retainer 23 is at the main locking position shown in FIG. 10. The front wall 25 of the female housing 21 and the front wall 40 of the retainer 23 match each other in the longitudinal direction when the retainer 23 is at the front locking position. Additionally, the front end of the lower auxiliary guide surface 31 and the rear end of the tab guide surface 42 of the retainer 23 are radially coincident with each other when the retainer 23 is at the main locking position, even when a maximum dimensional tolerance is generated between the resin of the female housing 21 and the resin of the retainer 23. Thus, the auxiliary guide surface 31 is assured of displaying the guide function. The front surfaces of the retainer 23 and the female housing 21 are substantially flush with each other when the retainer 23 is at the main locking position. The front surfaces of the retainer 23 and the female housing 21 fit on the front surface of the terminal fitting-holding part 13. The guide plate 39 guides the longitudinal movement of the retainer 23 when the guide plate 39 is inserted into the guide concavity 32 of the female housing 21.

Figure 4:
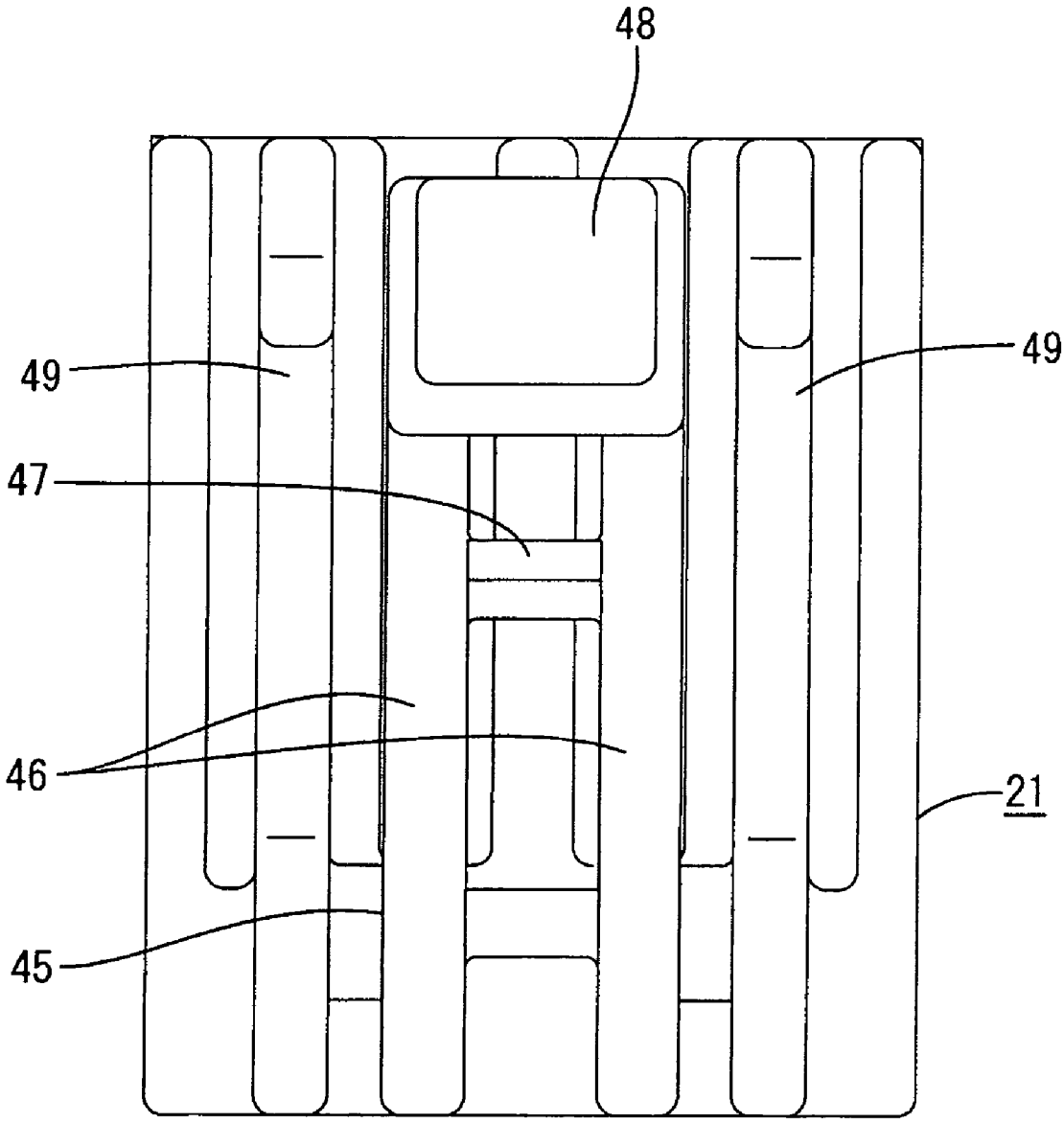
FIG. 4 is a plan view of the female housing.

As shown in FIGS. 3, 4, and 7, a locking arm 45 is provided at approximately the widthwise center of the upper surface of the female housing 21 for holding the male and female housings 11 and 21 together when the female housing 21 is fit in the male housing 11. The locking arm 45 has two cantilevered beams 46. A to-be-locked portion 47 connects midway positions of both beams 46, and an operation portion 48 connects rear ends of both beams 46. The beams 46 are spaced at a predetermined interval and are almost parallel with each other. Each beam 46 has a front end at the front of the female housing 21 and is elastically deformable about the front end in a vertical direction intersecting the longitudinal direction in which the housings fit together and move apart. A rear locking surface of the to-be-locked portion 47 is almost straight vertically. However, the front surface of the to-be-locked portion 47 slopes up from its front end towards its rear end. The operation portion 48 can be pressed from above to deform the locking arm 45 elastically. Protection walls 49 project on the upper surface of the female housing 21 on opposite sides of the locking arm 45 to positions higher than the locking arm 45. Two guide ribs 50 extend longitudinally at both widthwise sides of the lower surface of the female housing 21. A finger projection 51 extends between the guide ribs 50 at the rear end of the lower surface of the female housing 21.

Figure 2:
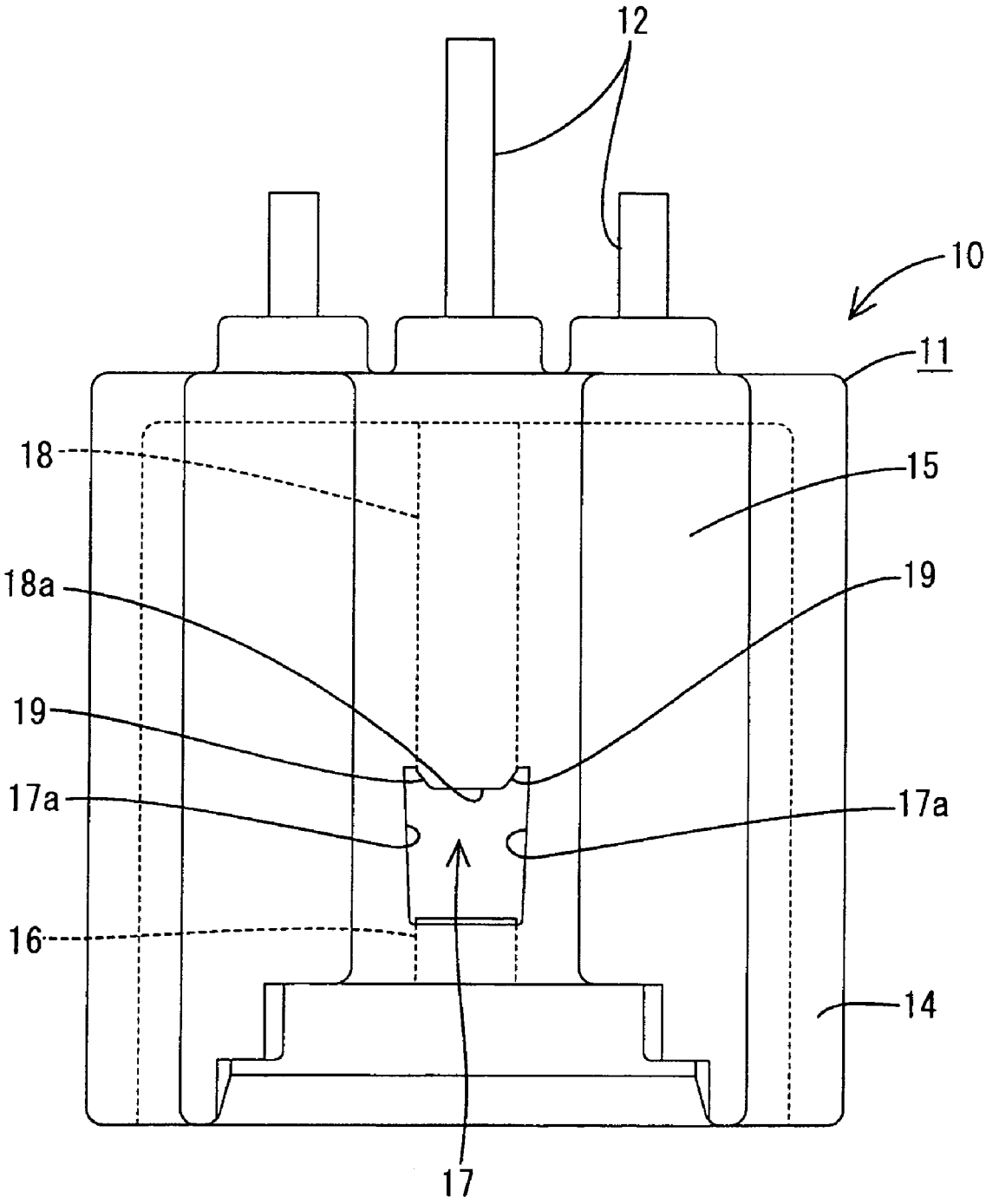
FIG. 2 is a plan view of the male housing.
Figure 21:
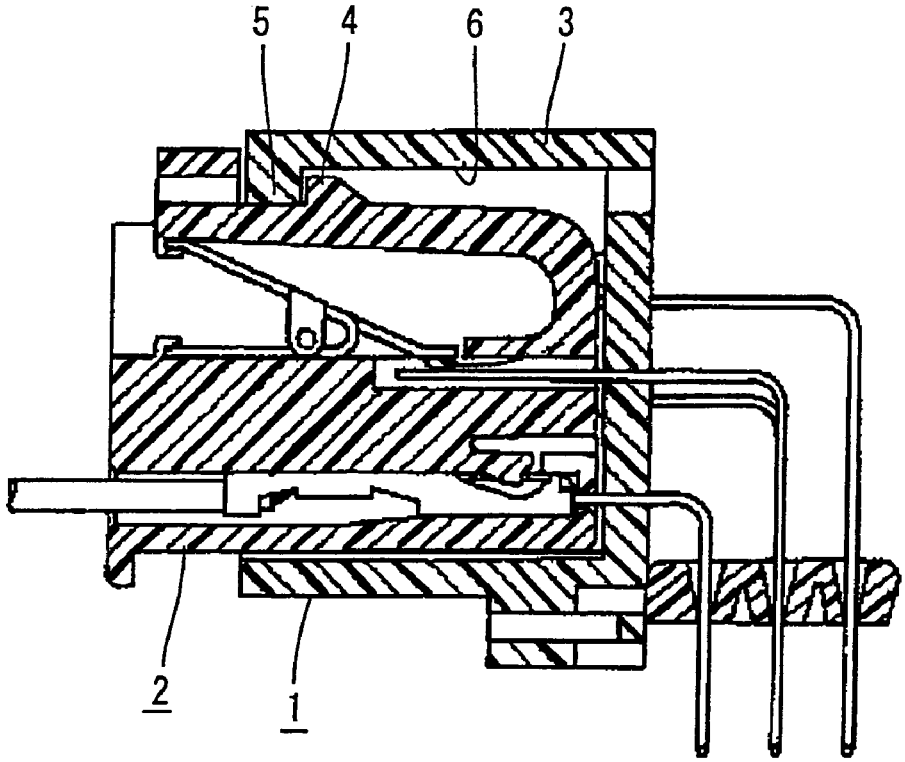
FIG. 21 is a sectional view showing a conventional art.

As shown in FIGS. 1 and 10, a locking claw portion 16 is provided on the upper wall 15 of the hood 14 of the male housing 11 and can be locked to the locking arm 45. The locking claw 16 projects in at approximately the widthwise center of the front end of the upper wall 15 of the hood 14. The front surface of the locking claw 16 slopes up from its rear end toward its front end so that the front surface thereof conforms to the slope of the front surface of the to-be-locked portion 47. The rear surface of the locking claw 16 also slopes up from its rear end toward its front end and can be locked to the to-be-locked portion 47. The locking claw 16 is slightly narrower than the interval between the beams 46 of the locking arm 45. A locking means penetration space 17 is formed rearward from the locking claw 16 and allows an advance of the to-be-locked portion 47 of the locking arm 45 therein. The locking means penetration space 17 is a hole that opens up to the outside through the upper wall 15 of the hood 14. Thus, the locking means penetration space 17 is formed along a direction almost orthogonal to the longitudinal direction of the male housing 11. The locking means penetration space 17 is formed with a molding die in which a core for shaping the locking means penetration space 17 is drawn up when a resin is molded into the male housing 11. This differs from the conventional art (FIG. 21) where a locking means penetration space is a longitudinal penetration through the terminal fitting-holding part. Therefore it is possible to prevent water from penetrating into the casing C, and the male housing 11 looks fine. As shown in FIG. 2, the locking means penetration space 17 is almost quadrilateral in a plan view.

Figure 12:
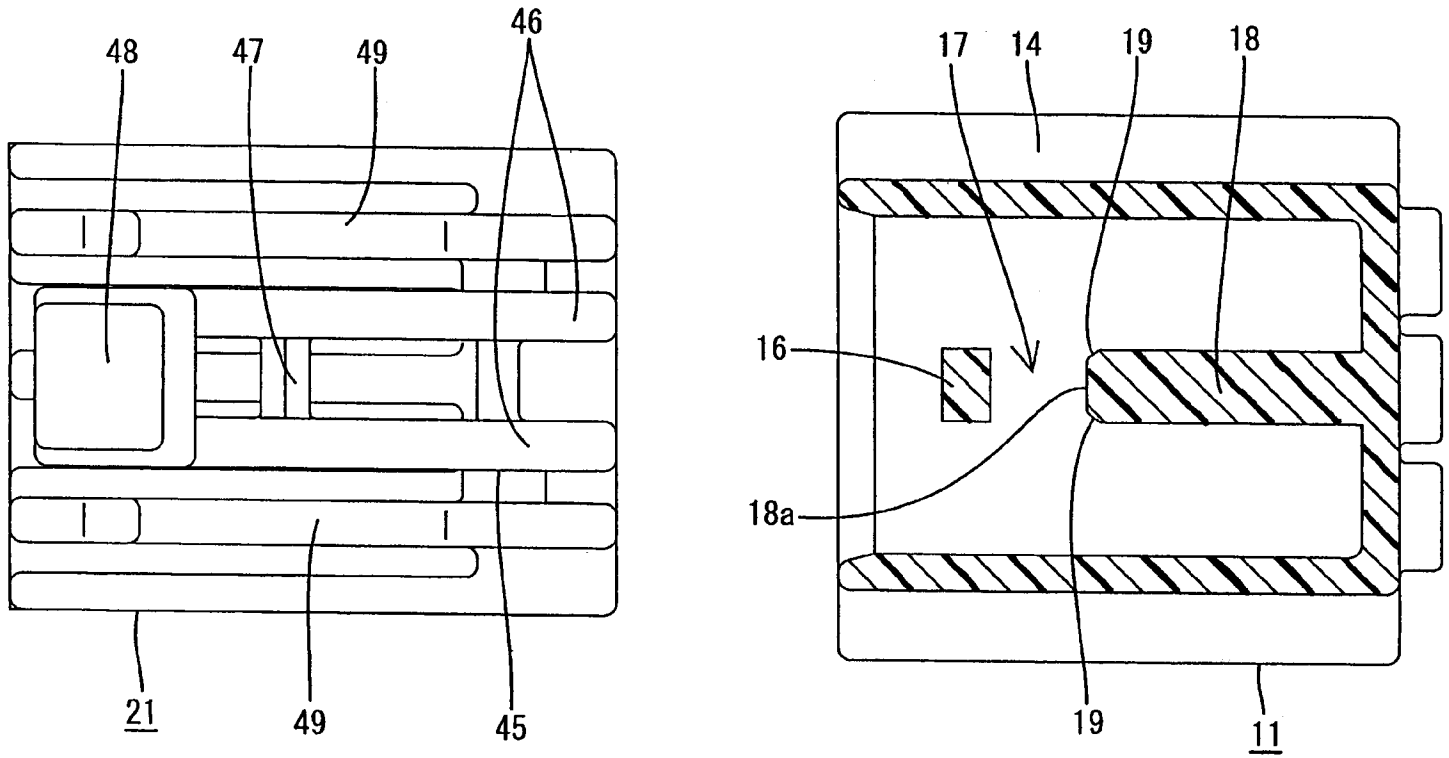
FIG. 12 is a sectional plan view before the housings are fit together.

As shown in FIGS. 10 and 12, a reinforcing rib 18 extends longitudinally on the upper wall 15 of the hood 14 rearward from the locking means penetration space 17. The reinforcing rib 18 projects in from the inner surface of the upper wall 15 of the hood 14 so that the reinforcing rib 18 is opposed to and rearward of the locking claw 16. The rear end of the reinforcing rib 18 is continuous with the front surface of the terminal fitting-holding part 13. The width and inward projecting distance of the reinforcing rib 18 almost equal those dimensions of the locking claw 16. The die for forming the reinforcing rib 18 has a forwardly drawn core for shaping the side surfaces of the reinforcing rib 18 and an upwardly drawn core for shaping the front surface. Thus, the die for shaping the locking means penetration space 17 shapes the front surface of the reinforcing rib 18.

As shown in FIGS. 2 and 12, corners at both sides of a front surface 18*a* of the reinforcing rib 18 are chamfered to form tapered guide surfaces 19. Inner surfaces of the beams 46 of the locking arm 45 slidably contact the guide surfaces 19 when the female housing 21 fits in the male housing 11. Thus, the female connector 20 is guided into the male connector 10. The width of the locking means penetration space 17 increases toward its rear end. The side surfaces 17*a* of the locking means penetration space 17 taper more gently than the guide surfaces 19. The distance between the tapered side surface 17*a* of the locking means penetration space 17 and the guide surface 19 that confronts the side surface 17*a* is wider than the distance between the longitudinally straight side surface 17*a* and the guide surfaces 19. Therefore, a sufficient thickness and a necessary strength can be obtained for the portion of the core of the die that is drawn up between the side surfaces 17*a* of the locking means penetration space 17 and the guide surfaces 19.

Figure 8:
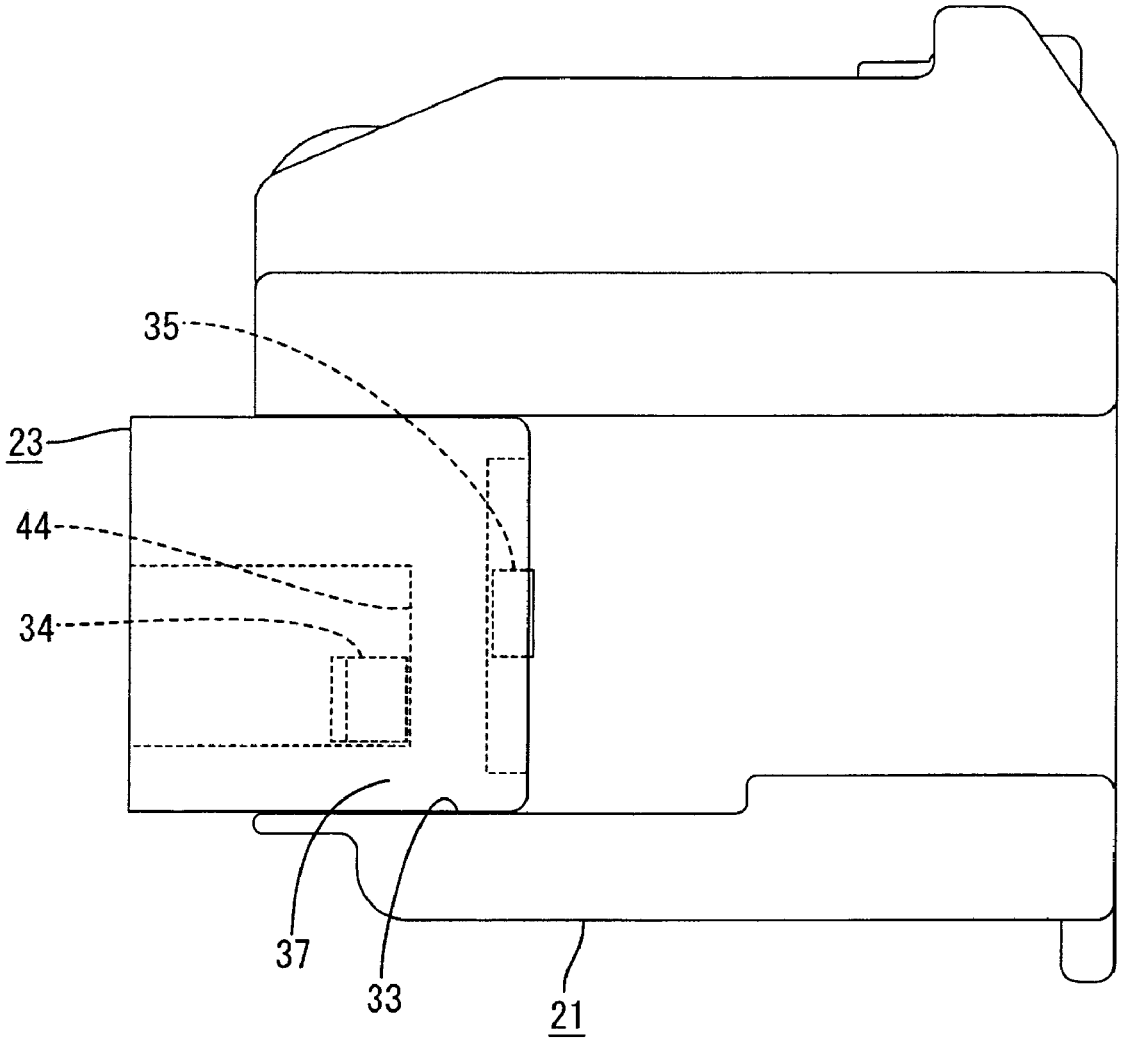
FIG. 8 is a side view of the female housing in which the front retainer is mounted on the temporary locking position.

The female connector 20 shown in FIGS. 7 and 8 is assembled by mounting the front retainer 23 at the temporary locking position in the female housing 21. The female terminal fittings 22 then are inserted into the respective cavities 24 from the rear. As a result, the female terminal fittings 22 press the lances 26 and the lances 26 deform elastically into the flexible space 27. The lances 26 return to their original state and enter locking holes when the female terminal fittings 22 are inserted into the cavity 24 to predetermined normal depths, as shown in FIG. 9. Accordingly, each lance 26 is locked to the peripheral edge of the locking hole to prevent removal of the female terminal fitting 22 from the cavity 24. The front retainer 23 then is pressed to the main locking position, as shown in FIGS. 10 and 11. As a result, the elastic deformation prevention portion 38 enters the flexible space 27 to prevent elastic deformation of the lance 26. Thus, the female terminal fitting 22 is held in the cavity 24 with a strong force.

Figure 13:
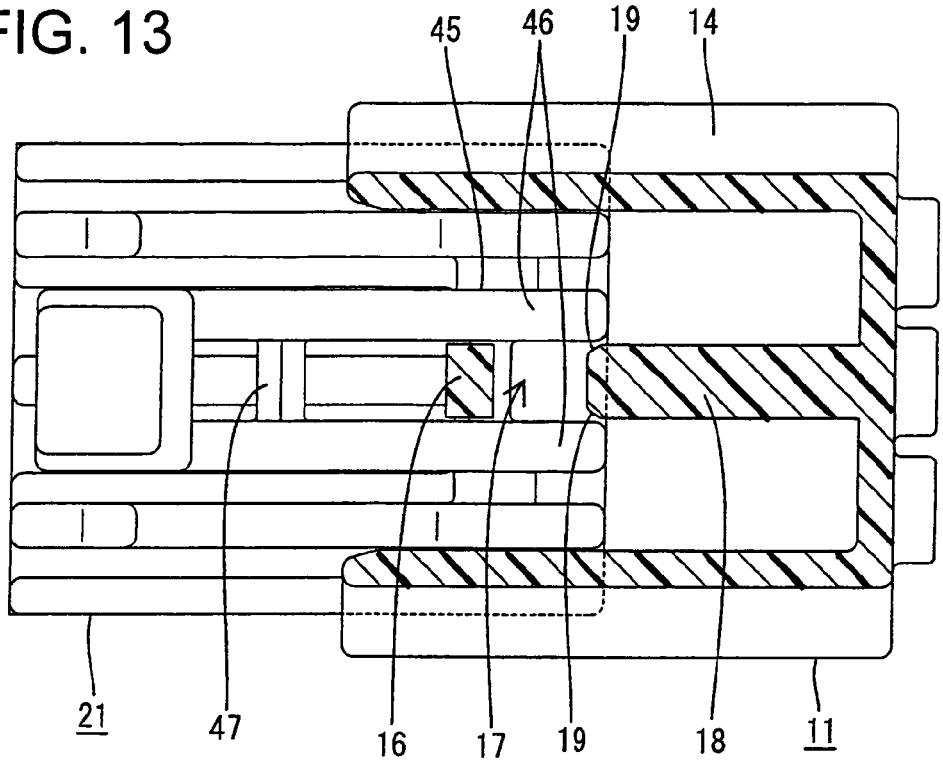
FIG. 13 is a sectional plan view of a state in which both housings are being fitted in each other.
Figure 14:
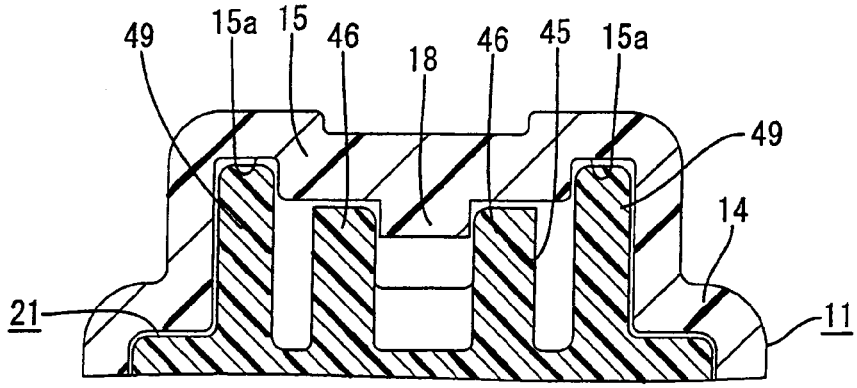
FIG. 14 is a partially sectional front view showing the relationship between a reinforcing rib and a locking arm, while both housings are being fitted in each other.
Figure 15:
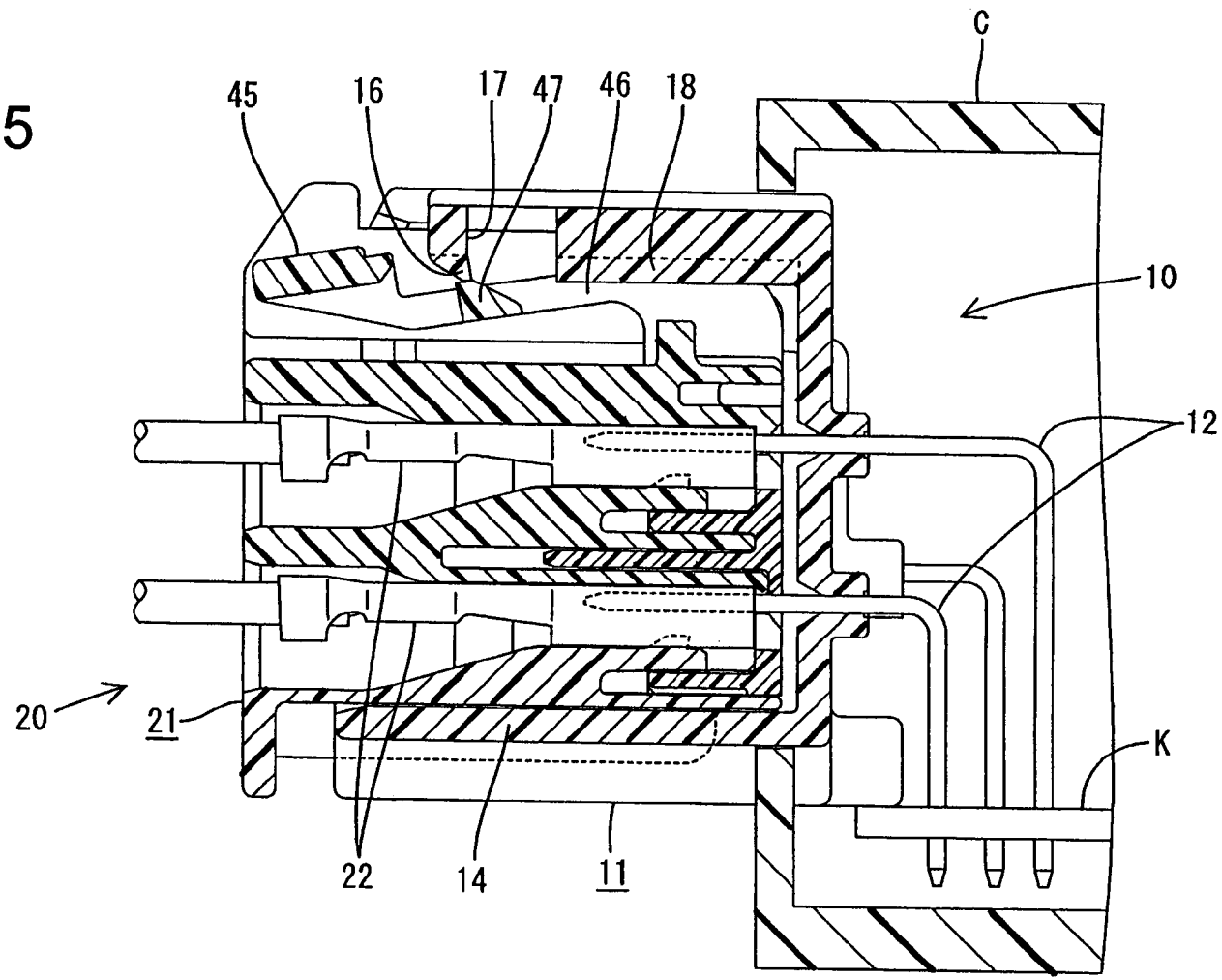
FIG. 15 is a sectional side elevation of a state while both housings are being fit together.

The assembled male connector 10 is mounted on the substrate K and in the casing C, as shown in FIG. 10. The female connector 20 then is fit in the male connector 10 outside of the casing C. More particularly, the guide rib 50 advances into the guide groove 14*a*, and the protection wall 49 advances into the receiving groove 15*a* to guide the female housing 21 into the hood 14. In this process, the locking claw 16 and the reinforcing rib 18 advance into the space between the beams 46, as shown in FIGS. 13 and 14. At this time, the guide surfaces 19 at the widthwise ends of the front surface 18*a* of the reinforcing rib 18 slidably contact the inner surface of the beams 46. Thus, the female connector 20 is fit smoothly into the male connector 10 and the female housing 21 is not caught by the reinforcing rib 18. The front surface of the to-be-locked portion 47 slidably contacts the front surface of the locking claw 16 when the female connector 20 enters the male connector 10 to a predetermined depth. Thus the to-be-locked portion 47 is pressed down, and the locking arm 45 deforms elastically down, as shown in FIG. 15.

Figure 16:
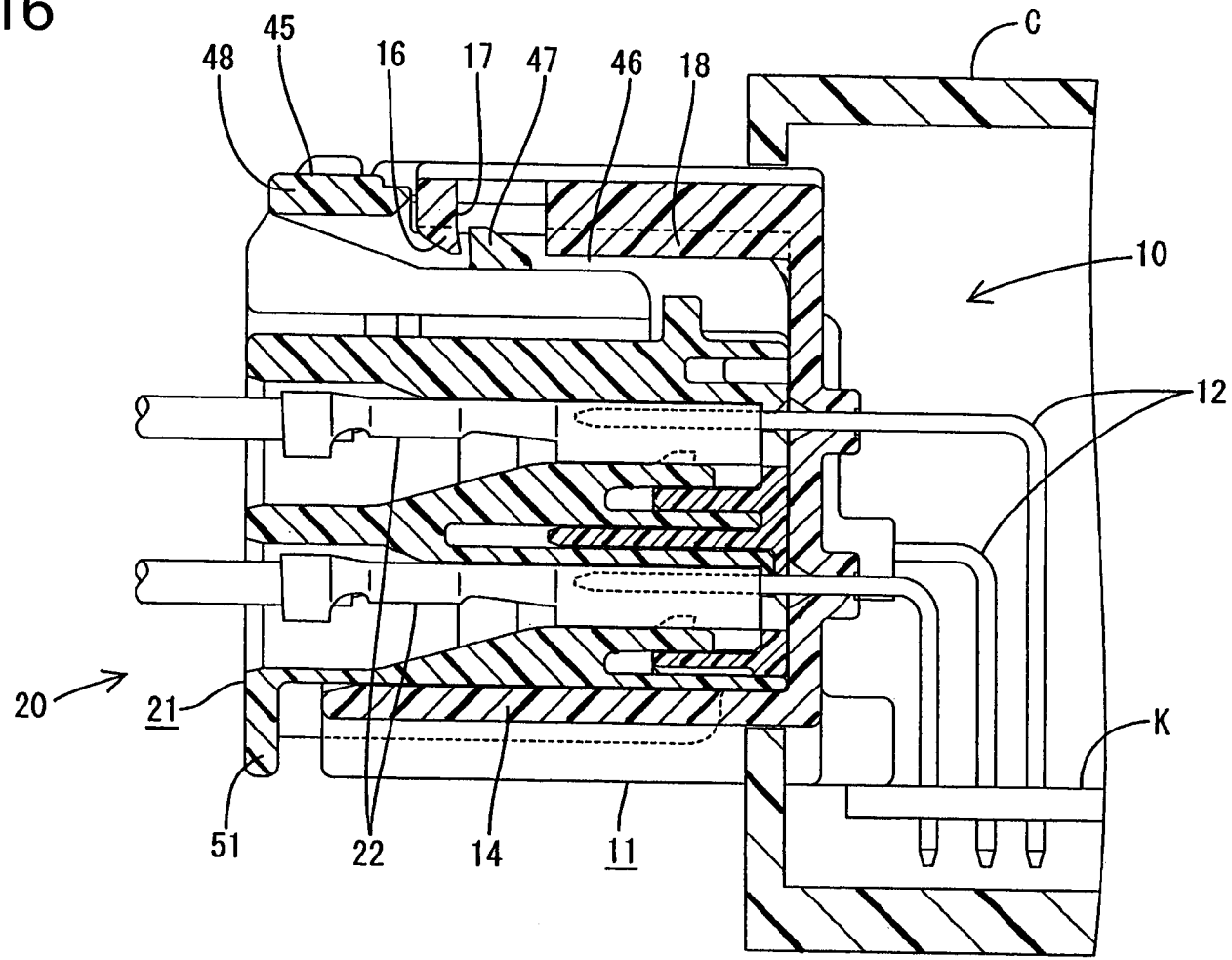
FIG. 16 is a sectional side elevation of a state in which both housings have been fitted in each other in a predetermined normal depth.
Figure 17:
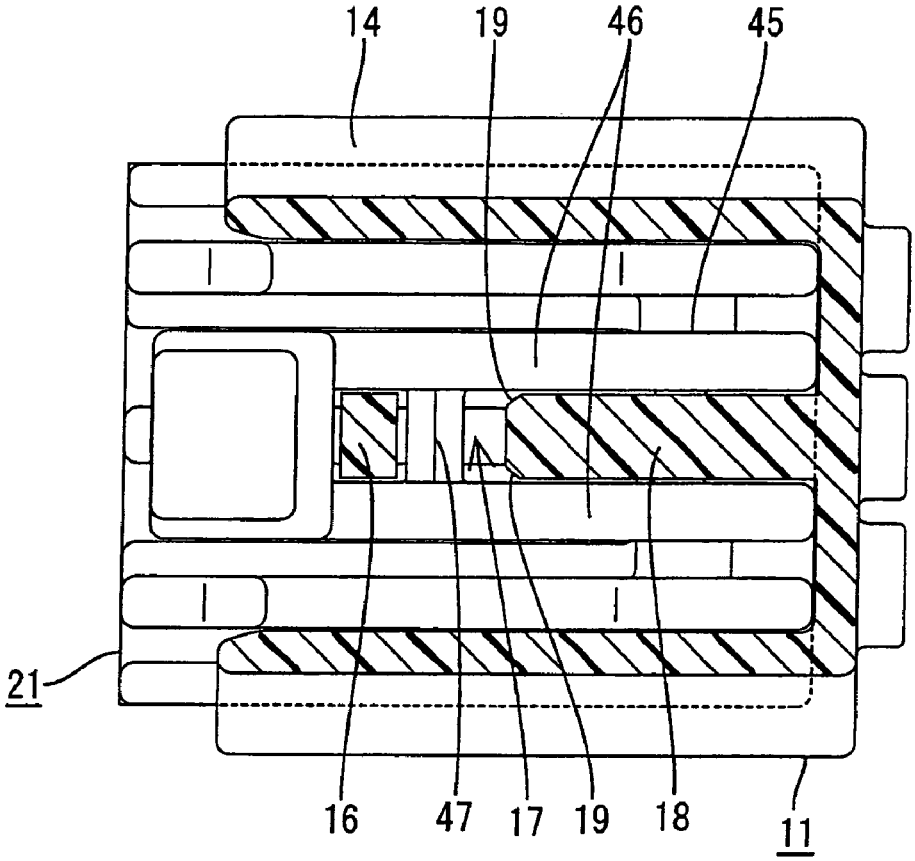
FIG. 17 is a sectional plan elevation of the state in which both housings have been fit together in the predetermined normal depth.

The locking arm 45 returns to its original state when the female housing 21 is fit in the male housing 11 to the predetermined normal depth where both fit-in surfaces contact each other, as shown in FIGS. 16 and 17. Therefore, the to-be-locked portion 47 advances into the locking means penetration space 17, and the rear surface of the locking means penetration space 17 is locked to the rear surface of the locking claw 16 to hold the housings 11, 21 together. At this time, the male terminal fitting 12 and the female terminal fitting 22 are connected electrically. The entire reinforcing rib 18 advances into the space between the beams 46 so that the front surface 18*a* of the reinforcing rib 18 is opposed to the front surface of the to-be-locked portion 47. In the normal fit-in state, the finger projection 51 and the front surface of the hood 14 are spaced at a predetermined interval so that an operator can grasp the finger projection 51 to separate the housings 11, 21.

As described above, the locking means penetration space 17 is a hole open to the outside along a direction intersecting the fit-in/separation direction of the female connector 20. Thus, the reinforcing rib 18 opposes the locking claw 16 at the rear of the locking means penetration space 17 and extends along the fit-in/separation direction of the female connector 20 to improve the strength of the hood 14. In the conventional construction (see FIG. 21) the locking means penetration space opens rearward along the fit-in/separation direction of the female connector 20, and a reinforcing construction cannot be formed in the area behind the locking means penetration space. On the other hand, the above-described connector of the first embodiment is designed with a high degree of freedom. The space between both beams 46 of the locking arm 45 is dead space into which the reinforcing rib 18 advances. This contrasts with designs in which the reinforcing rib 18 is in other places, and it is necessary to provide the female connector with a space for receiving the reinforcing rib. Therefore it is possible to simplify the female connector 20.

Further the guide surfaces 19 are formed at both widthwise ends of the front surface 18*a* of the reinforcing rib 18. Therefore, the guide surfaces 19 guide the female connector 20 into the hood 14, and the reinforcing rib 18 does not catch the female housing 21.

The gap between the guide surface 19 and the side surface 17*a* of the locking means penetration space 17 is narrow. Thus, portions of the molding die for shaping the locking means penetration space 17 and for shaping the guide surface 19 are narrow, and there is a fear that these portions will be weak. However, the locking means penetration space 17 becomes gradually wider towards the guide surface 19. Therefore, a larger gap exists between the guide surface 19 and the side surface 17*a* of the locking means penetration space 17, and portions of the molding die for shaping the locking means penetration space 17 and the guide surface 19 are sufficiently strong.

Figure 18:
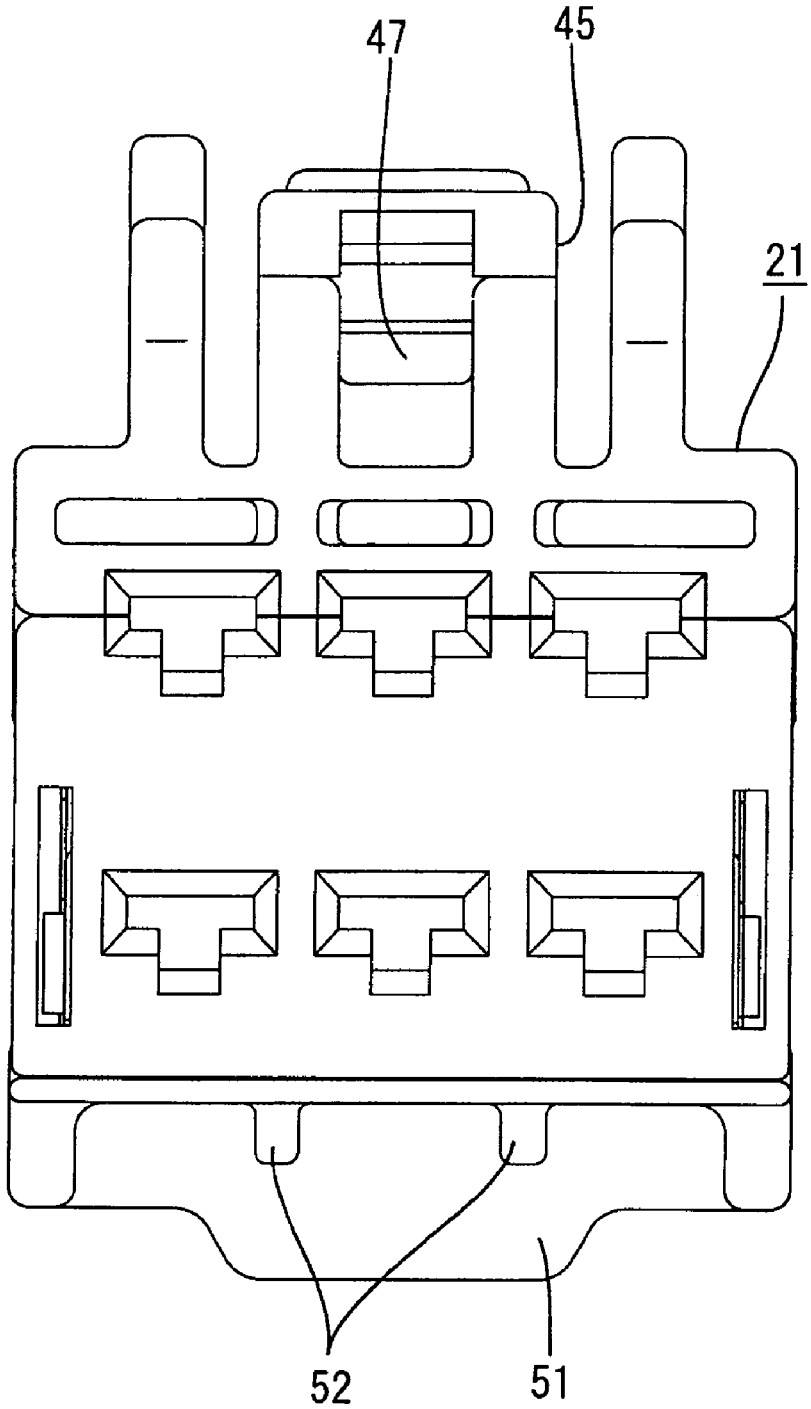
FIG. 18 is a front view of a female housing according to a second embodiment of the present invention.

The second embodiment of the invention is described below with reference to FIGS. 18 through 20. The female housing 21 of the second embodiment has a stop 52 in consideration of a possible change of the longitudinal dimension of the hood 14 of the male housing 11. The construction, operation, and effect of the second embodiment similar to those of the first embodiment are not described below. The casing C is not shown in FIGS. 19 and 20.

Figure 19:
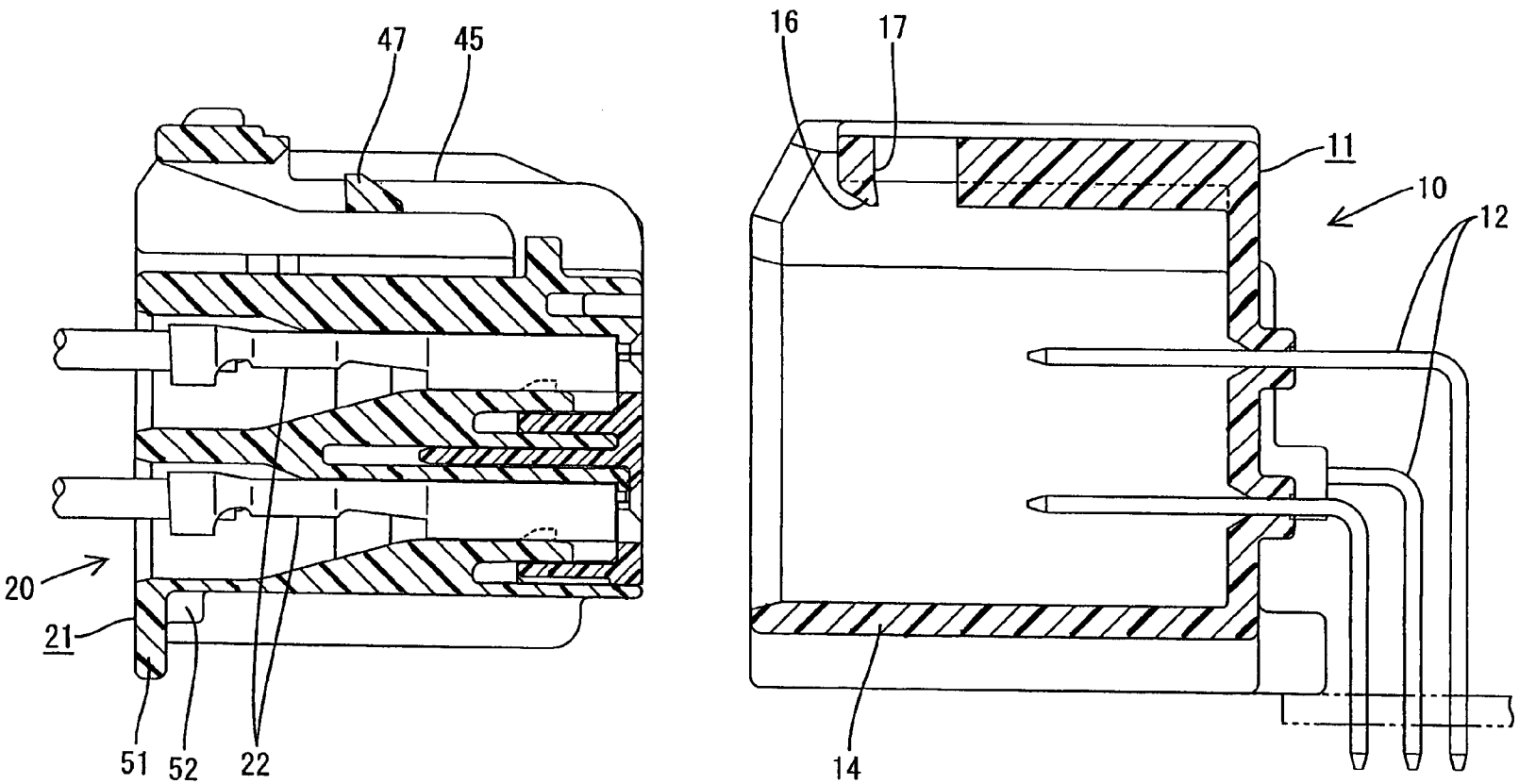
FIG. 19 is a sectional side elevation showing a state before both housings are fitted in each other.
Figure 20:
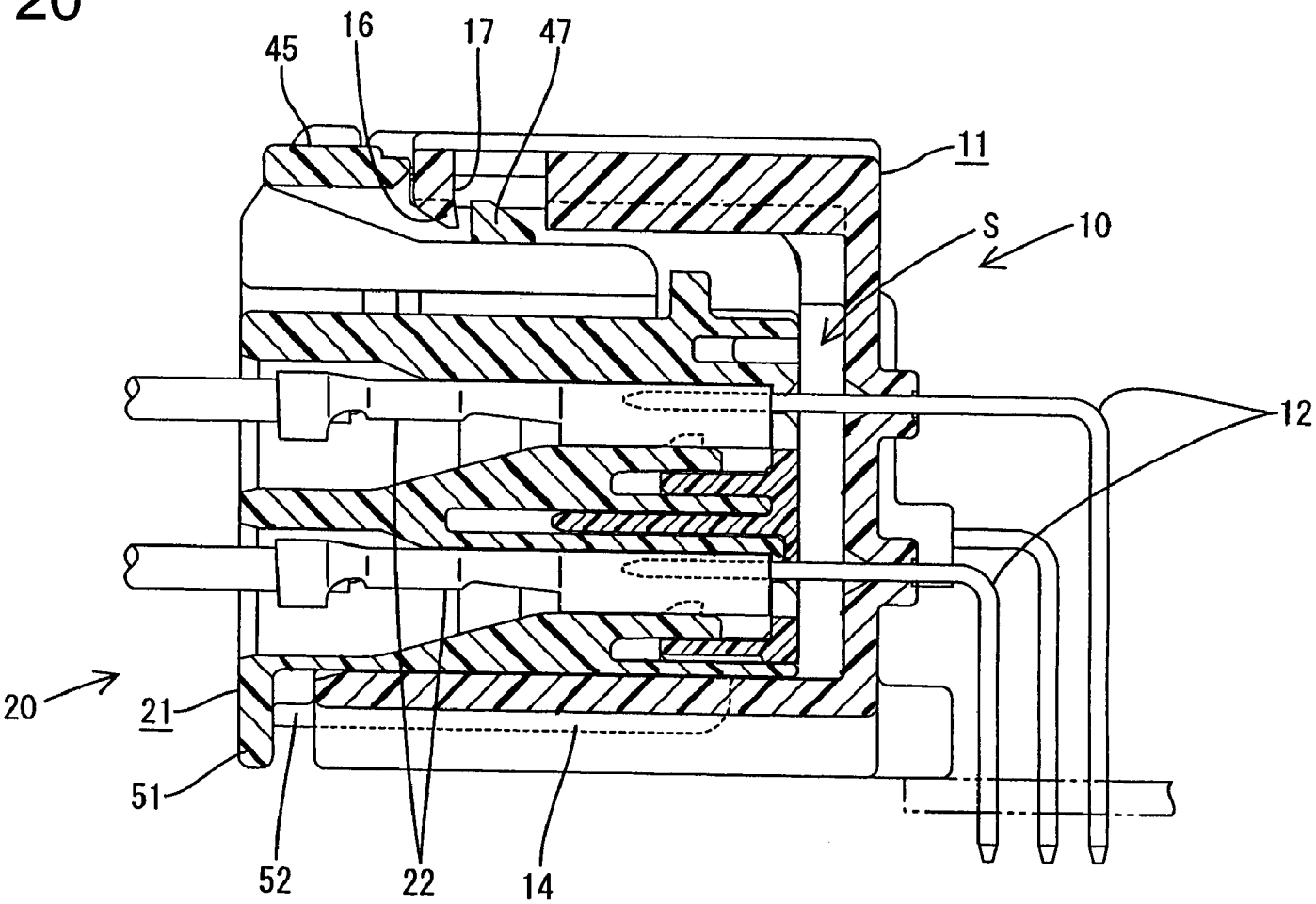
FIG. 20 is a sectional side elevation showing a state in which both housings have been fitted in each other in a predetermined normal depth.

As shown in FIG. 19, the hood 14 is longer than the hood that is suitable for the female connector 20 of the first embodiment. Therefore when the female connector 20 is fit in the male connector 10 to the normal depth, the fit-in surfaces of the male and female connectors 10 and 20 are spaced at a predetermined gap S (see FIG. 20). There is a possibility that the length of the hood 14 will change when one manufacturer manufactures the male connector 10 and another manufactures the female connector 20. As shown in FIGS. 18 and 19, two stops 52 project down from the lower surface of the female housing 21 for preventing the fit-in length of the female housing 21. The stops 52 are spaced at a predetermined interval in the width direction of the female housing 21. The rear end of each stop 52 is connected to the finger projection 51. The front surface of the stop 52 is vertically straight.

The locking arm 45 deforms elastically when the female connector 20 is pressed forward into the male connector 10 from the state shown in FIG. 19. However, the locking arm 45 returns to its original state when the female housing 21 is fit in the male housing 11 to the predetermined normal depth, as shown in FIG. 20. As a result, the to-be-locked portion 47 advances into the locking means penetration space 17 and is locked to the locking claw 16. At this time, the fit-in surfaces of the male and female connectors 10 and 20 do not contact, and a gap S formed therebetween. Thus there is a fear that the female housing 20 could be pressed forward beyond the predetermined normal position and that both terminal fittings 12, 22 connected to each other could be affected adversely. However, the front surfaces of both stops 52 of the female housing 21 strike the front surface of the lower portion of the hood 14 when the female housing 21 is fit in the male housing 11 to the predetermined normal depth, and further progress of the fit-in operation is prevented. Consequently, the female connector 20 cannot advance excessively into the hood 14 and the terminal fittings 12 and 22 are not affected adversely.

The invention is not limited to the embodiment described above with reference to the drawings. For example, the following embodiments are included in the technical scope of the present invention. Further, various modifications of the embodiments can be made without departing from the spirit and scope of the present invention.

The guide surface on both widthwise ends of the front surface of the reinforcing rib could be a curved surface, such as a circular arc, instead of the above-described tapered surface. Further, the guide surface may be removed from the reinforcing rib.

The configuration of the locking means penetration space can be altered as desired. For example, the width of the locking means penetration space does not have to gradually widen towards the guide surface.

The present invention is applicable to a type of a connector that is not mounted on the substrate or the casing.

The numbers of the male and female terminal fittings are alterable as desired. The configuration of the locking arm is also alterable as desired.

What is claimed is:

1. A connector, comprising;

a housing including a hood for receiving a mating connector;

a lock projecting inwardly on the hood for keeping the mating connector fitting in said hood when a to-be-lock portion of the mating connector is locked to said lock;

a locking means penetration space reward of said lock for receiving said to-be-lock portion of said mating connector, said locking means penetration space being open to areas outside the hood along a direction intersecting a fit-in/separation direction of said mating connector; and reinforcing potion protecting in from said hood at a rear of said locking means penetration space and opposed to said lock, the reinforcing projection extending in said fit-in/separation direction of said mating connector, guide surfaces formed at widthwise ends of a surface of said reinforcing portion opposed to the said lock for guiding the mating connector into said hood, and wherein a widthwise dimension of said locking means penetration space becomes gradually larger towards said guide surfaces.

2. The connector of claim 1 further comprising guide surfaces formed at widthwise ends of a surface of said reinforcement opposed to said lock for guiding the mating connector into said hood.

3. The connector of claim 1, wherein the hood is formed with grooves on opposite sides of the reinforcement for guiding the mating connector into the hood.

4. A connector assembly comprising:

a first connector having a first housing with opposite front and rear ends, a first and second spaced apart locking beams cantilever rearwardly from the front end of the first housing, a to-be-locked portion extending between the locking beams at a position rearward of the front end of the first housing; and a second connector having a second housing with opposite front and rear ends and a hood open at the front end of the second housing for receiving the front end of the first housing, the hood having opposite side walls extending substantially parallel to a mating direction between the first connector and the second connector and a top wall extending between the side walls and aligned substantially parallel to the mating direction, the top wall having opposite inner and outer surfaces and selected thicknesses measured between the inner and outer surfaces, an elongate reinforcement unitary with the housing and projected inward on the top wall of said hood at a position spaced inward from the side walls of the hood, the elongate reinforcement extending rearwardly from a location spaced rearward from said front end of said second housing, a lock projecting inward from the top wall of the hood at a position aligned with and forward of the reinforcement and spaced inwardly from the side walls of the hood, and a locking means penetration space extending outward through the top wall of the hood at locations spaced inward from the side walls of the hood and between the lock and the reinforcement for receiving said to-be-locked portion when said first housing is inserted into the hood, portions of the top wall of the hood at the lock and at the reinforcement having a thickness greater than portions of the top walls of the hood adjacent to and on opposite respective sides of the locking means penetration space, the lock and the reinforcement, the locking beams of the first housing being disposed for slidably advancing on opposite respective sides of the lock and the reinforcement as the first and second connectors are being connected.

5. The connector assembly of claim 4, wherein the lock and the reinforcement project substantially equal distances in from the wall of the hood.

6. The connector assembly of claim 5, wherein the lock and the reinforcement have substantially equal widths.

7. The connector assembly of claim 6, wherein the wall of the hood has grooves on opposite sides of the reinforcement for receiving walls of the first housing and guiding the first housing into the hood.

8. The connector assembly of claim 7, further comprising guide surfaces formed at widthwise ends of a surface of said reinforcement opposed to said lock for guiding the first housing into said hood.

9. The connector assembly of claim 8, wherein said locking means penetration space becomes gradually wider towards said guide surfaces.

10. The connector assembly of claim 5, wherein said first housing has a stop disposed for striking said hood and preventing insertion when said to-be-locked portion is pressed into said hood to a predetermined normal depth at which said to-be-locked portion is locked to said lock.

11. The connector assembly of claim 10, wherein the stop is on a wall of the first housing opposite the locking arm.

* * * * *